United States Patent [19]

Solomon et al.

[11] Patent Number: 4,875,238

[45] Date of Patent: Oct. 24, 1989

[54] MUSICAL GARMENT

[76] Inventors: Ruth Solomon, 500 Kingsridge Dr., Ballwin, Mo. 63011; Harvey J. Rosenberg, 217 S. Green Trails, Chesterfield, Mo. 63017

[21] Appl. No.: 244,872

[22] Filed: Sep. 15, 1988

[51] Int. Cl.[4] ..... A41B 1/02

[52] U.S. Cl. ..... 2/115; 2/75; 446/28

[58] Field of Search ..... 2/49 R, 49 A, 50, 51, 2/75, 80, 111, 112, 115, 94; 446/26, 27, 28, 143, 148, 7, 297, 298, 175, 485, 369; 229/92.8, 92.9; 283/47

[56] References Cited

U.S. PATENT DOCUMENTS

| | | | |
|---|---|---|---|
| 2,582,699 | 1/1952 | Jelaso et al. | 446/28 |
| 3,755,960 | 9/1973 | Tepper et al. | 446/299 |
| 3,777,310 | 12/1973 | Yang | 2/48 |
| 3,808,418 | 4/1974 | Conard et al. | 446/485 X |
| 4,464,861 | 8/1984 | Fogarty et al. | 446/485 X |
| 4,525,878 | 7/1985 | Lowe, Jr. | 2/185 |
| 4,570,206 | 2/1986 | Deutsch | 2/115 X |
| 4,601,120 | 7/1986 | Levin | 40/586 X |
| 4,601,668 | 7/1986 | Sirota | 446/485 X |
| 4,635,516 | 1/1987 | Giannini | 2/160 X |

OTHER PUBLICATIONS

German Publication Doc. No. DE 3730491 A1, Publication date 03/24/88 "Things You Never knew Existed . . . TM", 1985 Johnson Smith Co., 1985, item #2.

*Primary Examiner*—Werner H. Schroeder
*Assistant Examiner*—Jeanette E. Chapman
*Attorney, Agent, or Firm*—Smith & Schnacke

[57] ABSTRACT

A garment capable of playing a musical tune comprising a garment having incorporated into its fabric a musical element comprising a memory chip, a battery and a speaker, wherein said element plays a musical tune when depressed.

4 Claims, 1 Drawing Sheet

MUSICAL GARMENT

BACKGROUND OF THE INVENTION

1. Field of the Invention

The present invention relates to a garment, and more particularly, to a garment which includes an element capable of playing a musical tune.

2. Description of Prior Art

Novelty items of clothing have been in existence for a number of years. The most common article of clothing utilized as a novelty item is the T-shirt. Novelty T-shirts have achieved a great amount of success by appealing to one or more human senses.

Typically, the sense of sight has been primarily responsible for the commercial success of T-shirts. For example, printed graphics and artwork designs have been commonly employed.

Other novelty T-shirts have been designed to appeal to senses other than sight. The so-called "scratch and sniff" T-shirts have been marketed to appeal to the sense of smell. Similarly, T-shirts having variable textures have been designed to appeal to the sense of touch. T-shirts have been designed having bells and the like to appeal to the sense of hearing. However, no T-shirt has been developed which is capable of playing a musical tune.

Small electronic elements have been developed which are capable of playing a musical tune for a repeatable number of times. Such elements typically include a memory chip which stores the musical tune and a battery which is used to operate the chip. Such elements have been commonly used in novelty items such as buttons and greeting cards. However, until the present invention, these elements have not been associated with an article of clothing.

Accordingly, there exists a need in the art for an article of clothing containing an element which is capable of playing a musical tune.

SUMMARY OF THE INVENTION

The present invention resides in the ability of a garment to play a musical tune. This is accomplished by incorporating a small self-powered electrical musical element into a garment.

In accordance with the embodiment, the present invention comprises a garment capable of playing a musical tune wherein said garment has a small musical element sewn into the fabric of the garment.

Accordingly, it is an object of the present invention to produce a garment capable of playing a musical tune.

It is a further object of the present invention to produce a garment capable of playing a musical tune wherein said garment is machine washable.

These, and other objects will be readily apparent to one skilled in the art as reference is made to the detailed description of the preferred embodiment.

DETAILED DESCRIPTION OF THE PREFERRED EMBODIMENT

Figure 1:
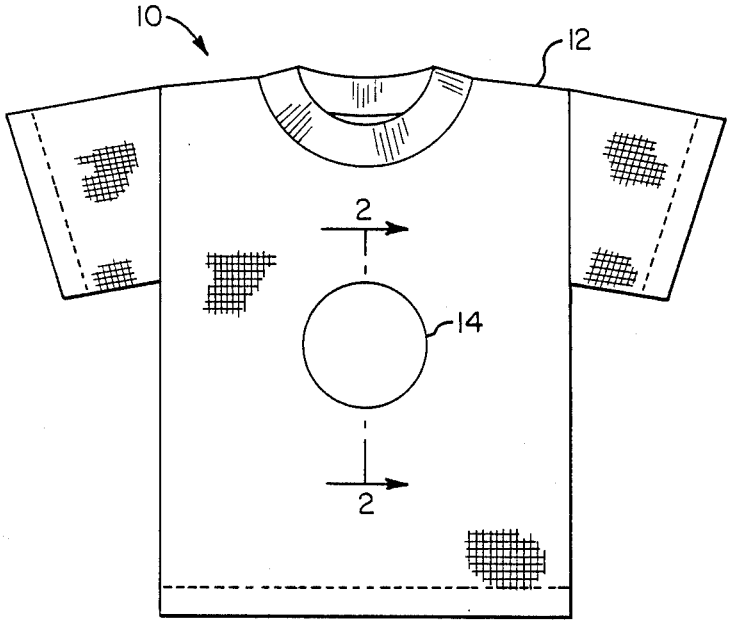
FIG. 1 is one embodiment of the musical garment of the present invention.
Figure 2:
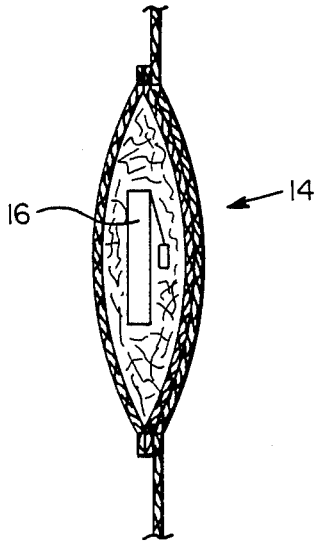
FIG. 2 is a view taken along line 2—2 of FIG. 1.

While referring to the preferred embodiment, certain terminology will be utilized for the sake of clarity. Such terminology is intended to cover the recited embodiment, as well as all equivalents which operate in a similar manner for a similar purpose to achieve a similar result.

The present invention resides in a garment 10 which contains an element capable of playing a musical tune. In the preferred embodiment, the garment comprises a T-shirt 12. However, the garment could also take the form of a sweat shirt, sweat pants, pants, sweaters, jerseys, shorts, socks and the like.

The T-shirt of the present invention is preferably made of cotton, polyester, or a cotton/polyester blend. However, other fabrics which may be woven into a garment such as wool and nylon may be utilized.

Incorporated into the garment is a musical element 16 which is capable of repeatedly playing a musical tune. The element comprises a memory chip, speaker, and a battery. Such elements are commonly available in novelty items such as buttons and greeting cards.

To incorporate the musical element 16 with the garment 10, the element 16 is inserted into the interior of a machine washable pouch 14, and the pouch 14 is sewn into the fabric of the garment. The use of a machine washable sealable pouch enables the shirt to be washed in a household washing machine without risking any damage to operability of the musical element. In the preferred embodiment, the pouch is made of a foam-like material, such as expanded nylon. As will be appreciated in the art, other materials which are machine washable and effectively cushion the musical element to prevent it from unnecessary shock during everyday wear or washing may be used.

For example, the musical element can be protected by using more than one protective pouch. The element may be inserted into the interior of a heat sealable water impermeable polymeric pouch.

To activate the musical element so that it can play a tune, the pouch containing the element is depressed. This causes the battery to electrically connect with the memory chip and causes the chip to play the musical tune through the speaker. To repeat the playing of the tune, the pouch is depressed again. This procedure can be repeated until the battery of the element wears out.

Having described the invention in detail and by reference to the preferred embodiment thereof, it will be apparent that modifications and variations are possible without departing from the scope of the appended claims.

What is claimed is:

1. A garment capable of playing a musical tune comprising a garment having incorporated into its fabric a musical element comprising a memory chip, a battery and a speaker, wherein said element plays a musical tune when depressed;

said garment being a garment selected from the group consisting of T-shirt, sweat shirt, sweat pants, pants, sweater, jersey, shorts and socks;

said garment being machine washable such that said musical element maintains operability after said garment is washed; and wherein said machine washable feature of said garment is obtained by maintaining said musical element in the interior of a machine washable pouch, and wherein said machine washable pouch is sewn into the fabric of said garment.

2. The garment according to claim 1 wherein said garment comprises a T-shirt.

3. The garment according to claim 1 wherein said garment comprises a sweat shirt.

4. The garment according to claim 1 wherein said machine washable pouch comprises an expanded nylon pouch.

* * * * *